US007662337B2

(12) United States Patent
Ehle et al.

(10) Patent No.: US 7,662,337 B2
(45) Date of Patent: Feb. 16, 2010

(54) HOISTING MECHANISM FOR STEEL PROCESSING LADLES IN RH DEGASSERS

(75) Inventors: Joachim K. Ehle, Lautenbach (DE); Markus Huellen, Düsseldorf (DE); Michael Kurlbaum, Gelsenkirchen (DE); Reinhard Pannenbäcker, Dorsten (DE); Arno Luven, Krefeld (DE); Joohen Sowinski, Wesel (DE)

(73) Assignee: Siemens VAI Metals Technologies GmbH (DE)

( * ) Notice: Subject to any disclaimer, the term of this patent is extended or adjusted under 35 U.S.C. 154(b) by 339 days.

(21) Appl. No.: 11/757,197

(22) Filed: Jun. 1, 2007

(65) Prior Publication Data

US 2007/0278722 A1 Dec. 6, 2007

(30) Foreign Application Priority Data

Jun. 2, 2006 (DE) ..... 10 2006 026 330

(51) Int. Cl.
*C21C 5/46* (2006.01)

(52) U.S. Cl. ..... 266/276; 266/240

(58) Field of Classification Search ..... 266/276, 266/240

See application file for complete search history.

(56) References Cited

U.S. PATENT DOCUMENTS 3,201,224 A 8/1965 Grim
3,756,584 A 9/1973 Mevissen
4,286,738 A * 9/1981 Blum ..... 222/591
4,946,142 A * 8/1990 Vatant ..... 266/276
5,098,251 A * 3/1992 Kress et al. ..... 414/458

FOREIGN PATENT DOCUMENTS

| | | |
|---|---|---|
| DE | 7217263 | 5/1972 |
| DE | 7416202 | 5/1974 |
| EP | 0 328 510 | 8/1988 |
| JP | 02-122014 | 5/1990 |
| SU | 840 138 | 6/1981 |
| SU | 908 847 | 2/1982 |

OTHER PUBLICATIONS

"Secondary Metallurgy—Fundamentals, Processes, Applications", Verlag Stahleisen GmbH, Dusseldorf, 2002 ISBN 3-514-00648-2 Fig. 3.2.1.5, Dec. 2002.

* cited by examiner

*Primary Examiner*—Scott Kastler
(74) *Attorney, Agent, or Firm*—Robert W. Becker; Robert Becker & Assoc.

(57) ABSTRACT

A hoisting mechanism for raising a ladle filled with liquid steel from a transfer vehicle to immersion pipes of a vacuum treatment tank of an RH degasser. Two lifting arms are provided, one end of which can be brought into engagement with a support device formed on the ladle, and a bearing end of the arms is supported in a stationary saddle support comprised in such a way of a runway, disposed on the bearing ends of the lifting arms and having the shape of a circular arc, and of a path of rolling contact, adapted to axially fixedly guide the runway during pivoting of the lifting arms, that due to shifting of the point of load introduction in the saddle support occurring during a raising movement, reduction of a horizontal movement of the ladle occurs.

14 Claims, 5 Drawing Sheets

HOISTING MECHANISM FOR STEEL PROCESSING LADLES IN RH DEGASSERS

The instant application should be granted the priority date of Jun. 2, 2006 the filing date of the corresponding German patent application 10 2006 026 330.8-24.

BACKGROUND OF THE INVENTION

The present invention relates to a hoisting mechanism for raising a ladle filled with liquid steel from a ladle transfer vehicle to the immersion pipes of the vacuum treatment tank of an RH degasser.

In a so-called RH degasser, liquid steel is subjected to a vacuum treatment by immersing the immersion pipes of the vacuum treatment tank into the liquid steel that is disposed in the ladle. To keep the treatment times short, the requirement exists to design the diameter of the immersion pipes as large as possible in correspondence to the ladle dimensions. In operational practice, for this purpose in one embodiment the vacuum treatment tank is lowered into the ladle, which rests upon a ladle transfer vehicle. However, this has the drawback that the vacuum treatment tank has numerous connections for the vacuum generation and for conducting treatment gasses through and for withdrawing them, so that each movement of the vacuum treatment tank means a corresponding stress upon its connections and the lines connected thereto.

Alternatively, the ladies are raised by suitable hoisting mechanisms from the ladle transfer vehicle, or also along with the transfer vehicle, and are brought to the immersion pipes of the fixedly installed vacuum treatment tank. This is accomplished by crane cable suspension means or hydraulic lifting mechanisms that ensure an exact vertical movement of the ladle, since due to the desired large immersion pipe diameter, the exact positioning of the ladle relative to IC) the immersion pipes must be ensured. Such crane cable suspension means, and also hydraulic lifting mechanisms, unfortunately require a lot of space and therefore require a correspondingly large capital investment.

Of a more economic design are hoisting mechanisms having a pivot arm that is movable by a hydraulic cylinder and is rotatable about a swivel joint during the raising or lowering movement. Such a pivot arm hoisting mechanism is known for the movement of the vacuum treatment tank of an RH degasser and can be seer, for example, in the publication "Secondary Metallurgy-Fundamentals, Processes, Applications", publisher Stahleisen GmbH, Düsseldotf 2002, FIG. 3.2.1.5.

The drawback of such pivot hoisting mechanisms is that during the rotational movement of the pivot arm, there inevitably results not only a vertical movement, in other words a lifting movement, of the ladle that is supported by the pivot arm, but also a horizontal movement, which is dependent upon the pivot angle and the corresponding radii, along with a horizontal displacement of the vertical axis of the ladle. With the use of such a pivot lifting mechanism for bringing a ladle to the immersion pipes of a vacuum treatment tank, this kinematic would lead to a corresponding reduction of the diameter of the immersion pipes in order to take into account the horizontal movement of the ladle during its lifting or lowering movements.

It is therefore an object of the present invention for a ladle that contains liquid steel for the raising from a ladle transfer vehicle to the immersion pipes of the vacuum treatment tank of an RH degasser, to provide a lifting mechanism that operates on the basis of pivotable lifting arms, yet largely without having a horizontal movement of the ladle occur during the pivoting movement of the lifting arms.

BRIEF DESCRIPTION OF THE DRAWINGS

This object, and other objects and advantages of the present invention, will appear more clearly from) the following specification in conjunction with the accompanying schematic drawings, in which:

FIGS. 8-9 show another embodiment of the subject matter of FIGS. 3 and 4.

SUMMARY OF THE INVENTION

Figure 2:
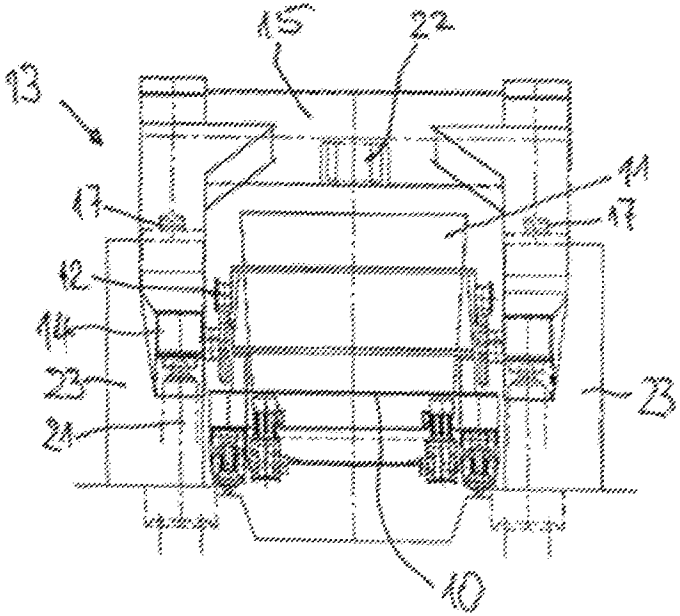
FIG. 2 is a front view of the subject matter of FIG. 1.

The fundamental concept of the present application is a hoisting mechanism comprised of two lifting arms, one end of which is to be brought into engagement with support devices formed on the ladle, the other, bearing end of which is supported in a stationary saddle support comprised in such a way of a runway which is disposed on the bearing ends of the lifting arms and has the shape of a portion of a circular arc, and of a path of rolling contact, which axially fixedly guides the runway during the pivoting movement of the lifting arms, that due to the shifting of the point of load introduction in the saddle support that occurs during the raising movement, a reduction of the horizontal movement of the ladle occurs.

The invention has the advantage that with the pivoting of the lifting arms for the raising or lowering of the ladle, due to the formation of the saddle support with a circular arc shaped runway that rolls on a stationary path of rolling contact, and the displacement of the pivot point connected therewith for the pivoting movement of the lifting arms, a horizontal displacement of the lifting arms is also effected by means of which the horizontal shifting of the ladle connected with the pivot path during the raising or lowering movement of the ladle is compensated for.

To take into account the considerable forces that occur, pursuant to one embodiment of the invention the circular arc shaped runway and the fixed path of rolling contact can be provided with interengaging teeth.

Depending upon the installation conditions of such a hoisting mechanism, as an alternative to a constant radius of the circular arc-shaped runway, pursuant to one embodiment the radius of the circular arc-shaped runway can vary as a function of the pivot position and the length of the lifting arms, and as a consequence thereof the runway can have a curved shape. Thus, a better adaptation of the amount of the horizontal shifting of the lifting arms in the pivot support is possible as a function of the pivot angle.

Pursuant to a preferred embodiment of the invention, the two lifting arms are interconnected by a transverse connection support that extends over the ladle transfer vehicle, whereby the transverse connection support, which is pivoted by the movement of the lifting arms, is supported and guided in the saddle support. Due to the symmetrical arrangement and configuration of the lifting arms with the transverse connection support, a good accommodation of load, even in the saddle support, is ensured.

Alternatively, the circulars arc-shaped runway can itself be formed directly on the transverse connection support, or the transverse connection support can be supported in a housing box and the circular arc-shaped runway can be formed on the housing box.

Although pursuant to one embodiment of the invention each of the two lifting arms can be acted upon by an associated hydraulic cylinder, pursuant to a special embodiment of the invention it is also possible for a hydraulic cylinder to be associated with only one of the lifting arms and for the transverse connection support to have such a torsional strength that the second lifting arm is taken along during movement of the first lifting arm that is acted upon by the hydraulic cylinder.

To facilitate the operating sequences and to shorten the process cycle times, pursuant to an embodiment of the invention the transverse connection support can extend over the ladle transfer vehicle at such a height that the transfer vehicle, with the ladle supported thereon, can be movable under the transverse connection support so that the ladle transfer vehicle is freely movable under the hoisting mechanism.

Since the ladle must respectively remain vertically oriented during the pivoting movement of the lifting arms, pursuant to one embodiment for a ladle having support devices embodied as trunnions that project radially on both sides, the ends of the lifting arms can be provided with cradle-like receiving means for the trunnions that enable a relative movement of the trunnions to the lifting arms. In this way, the ladle with its trunnions is movably suspended in the cradle-like receiving means and respectively automatically vertically orients itself, even during a pivoting movement of the lifting arms.

In an alternative embodiment, ladles having trunnions that radially project on both sides, and plates that are rotatably or pivotably supported thereon, are provided as support devices, whereby the plates serve for the suspension of crane hooks for the movement of the ladies in an operating sequence. Since the plates are pivotable relative to the trunnions that are disposed on the ladle, during handling of the ladle by means of handling devices that engage the plates, the ladle respectively automatically vertically orients itself. For this purpose the ends of the lifting arms can be provided with receiving means that extend under the plates in a positive or formfitting manner, so that during the lifting or lowering movement of the ladle, as well as during the treatment time, the ladle is supported via the plates in the receiving means of the lifting arms; an inclined position of the plates in the raised treatment position of the ladle is not a drawback in this connection, because the ladle is pivotably supported in the plates and therefore vertically orients itself due to the low-lying center of gravity.

Further specific features and advantages of the present application will be described in detail subsequently.

DESCRIPTION OF SPECIFIC EMBODIMENTS

Figure 1:
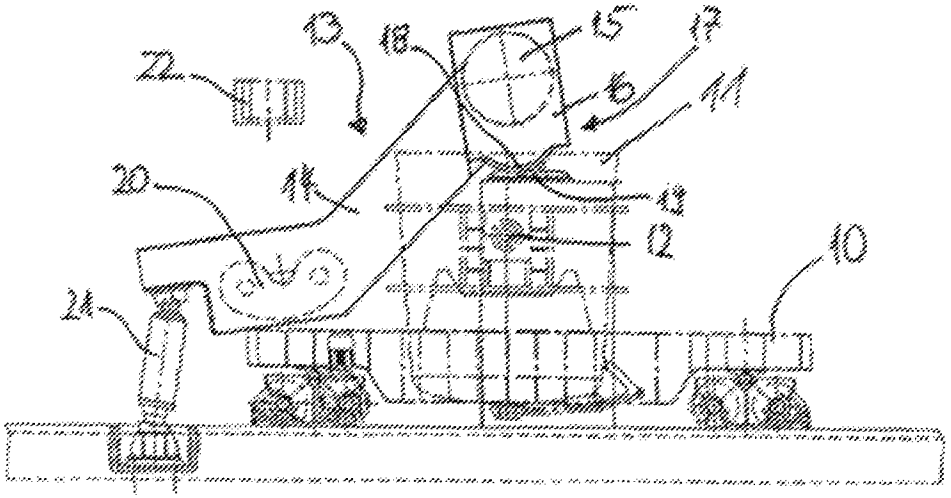
FIG. 1 is a side view of a hoisting mechanism with a ladle transfer vehicle before it.

Referring now to the drawings in detail, as shown initially in FIGS. 1 and 2, a ladle transfer car or vehicle 10 serves for the transport of a ladle 11; during handling of the ladle 11, it is supported on the transfer vehicle 10. For the engagement of handling devices during the normal operational sequence, in the illustrated embodiment the ladle 11 is provided with laterally projecting trunnions 12 as a holding device, so that, for example, crane hooks can engage the trunnions 12 of the ladle 11.

The reference numeral 13 designates a hoisting mechanism for the ladle 11 by means of which the ladle can be raised to only schematically illustrated immersion tubes or pipes 22 of a not further illustrated vacuum treatment tank. The hoisting mechanism 13 is comprised of two lifting arms 13, which car) engage the trunnions 12 of the ladle 12 on both sides. As can be seen by looking at FIGS. 1 and 2, the two lifting arms 14 are connected to one another by means of a transverse connection support 15 that is supported in a housing box 16. The housing box 16 is supported by foundation bases 23 that are disposed laterally of the path of movement for the ladle transfer vehicle 10, so that a portal-like device as the hoisting mechanism 13 that extends over the ladle transfer vehicle 10 is formed. In this connection, the lateral foundation bases 23 have such a height that the transverse connection support 15 extends over the ladle transfer vehicle 10 with the ladle 11 supported thereon, at such a height that the transfer vehicle 10 with the ladle 11 thereon can be moved through the hoisting mechanism 13.

To the extent that a saddle support 17 is provided for the pivoting of the lifting arms 14, the transverse connection support 15 is mounted in a housing box 16 on the undersides of which are formed a respective runway 18 that has the shape of a portion of an arc of a circle and that rests upon a stationary path 19 of rolling contact that upon the pivoting movement of the lifting arms 14 guides the circular arc-shaped runway 18 in its longitudinal direction.

The front ends of the lifting arms 14 are each provided with a cradle-like receiving means 20 for extending under the trunnions 12 of the ladle 11. Due to the special configuration of the receiving means 20, the trunnions 12 of the ladle 11 can move relative to the lifting arms 14 in the cradle-like receiving means 20, so that the ladle 11 that rests in the receiving means 20 via the trunnions 12, as will be described in detail subsequently, automatically has its vertical axis 27 oriented vertically due to the low center of gravity.

Hydraulic cylinders 21 engage the front ends of the lifting arms 14; upon their extension, the hydraulic cylinders 21 raise the lifting arms 14 and hence also the ladle 11. In the illustrated embodiment, with a respective hydraulic cylinder 21 being associated with each lifting arm 14, if one of the cylinders breaks down it is possible to lower the ladle from the raised position in a controlled manner by means of the remaining hydraulic cylinder.

Figure 4:
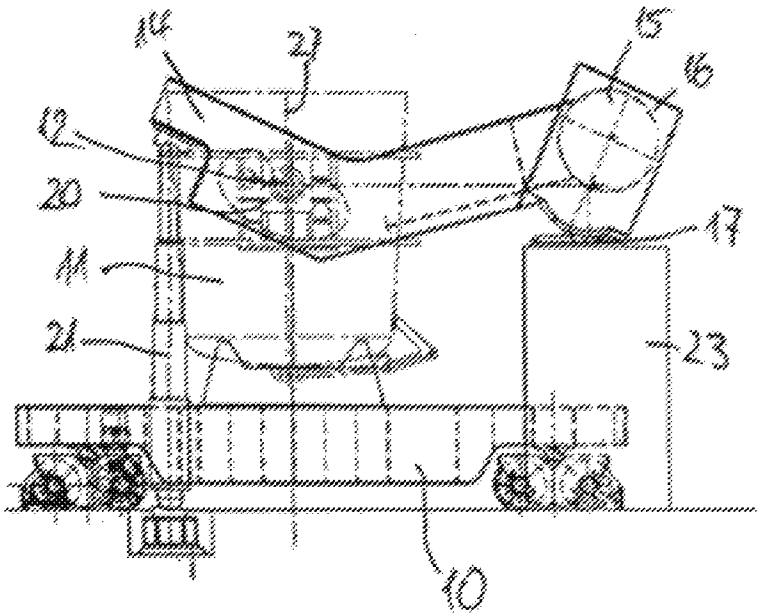
FIG. 4 shows the hoisting mechanism of FIG. 1 or 3 with the ladle raised from the ladle transfer vehicle and into an upper treatment position.
Figure 3:
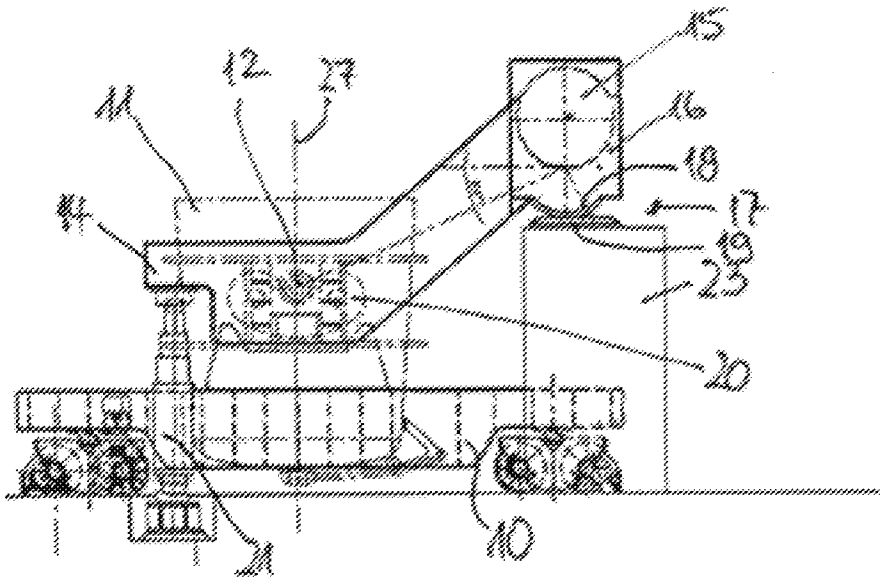
FIG. 3 shows the hoisting mechanism of FIG. 1 upon engagement of the lifting arms against the ladle.

The raising process can be seen from FIGS. 3 and 4. FIG. 3 illustrates that phase of operation in which the trunnions 12 of the ladle 11 are moved over the cradle-like receiving means 20 of the lifting arms 14, and the lifting arms 14 are raised by the hydraulic cylinders 21 already to such an extent that the trunnions 12 rest in the cradle-like receiving means 20. Upon further extension of the hydraulic cylinders 21, as shown in FIG. 4, the ladle 11 is raised in the direction of the immersion pipes 22, which are not illustrated in FIGS. 3 and 4, whereby due to the special configuration of the saddle support 17 for the lifting arms 14, which will be explained subsequently, the horizontal displacement of the vertical axis of the ladle 11 that occurs with a pivoting hoisting mechanism is compensated for. It can be seen that in the raised position of the ladle 11 of FIG. 4, a hardly noticeable horizontal displacement of the vertical axis 27 of the ladle 11 has occurred that can be disregarded during operation.

Figure 5:
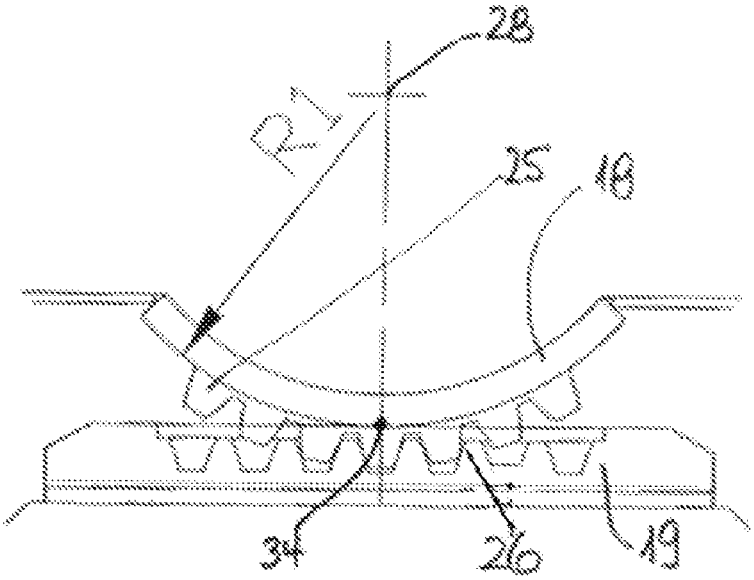
FIG. 5 is an enlarged detailed illustration of the saddle support having a runway with the shape of a portion of a circular arc, and a stationary path of rolling contact.
Figure 7:
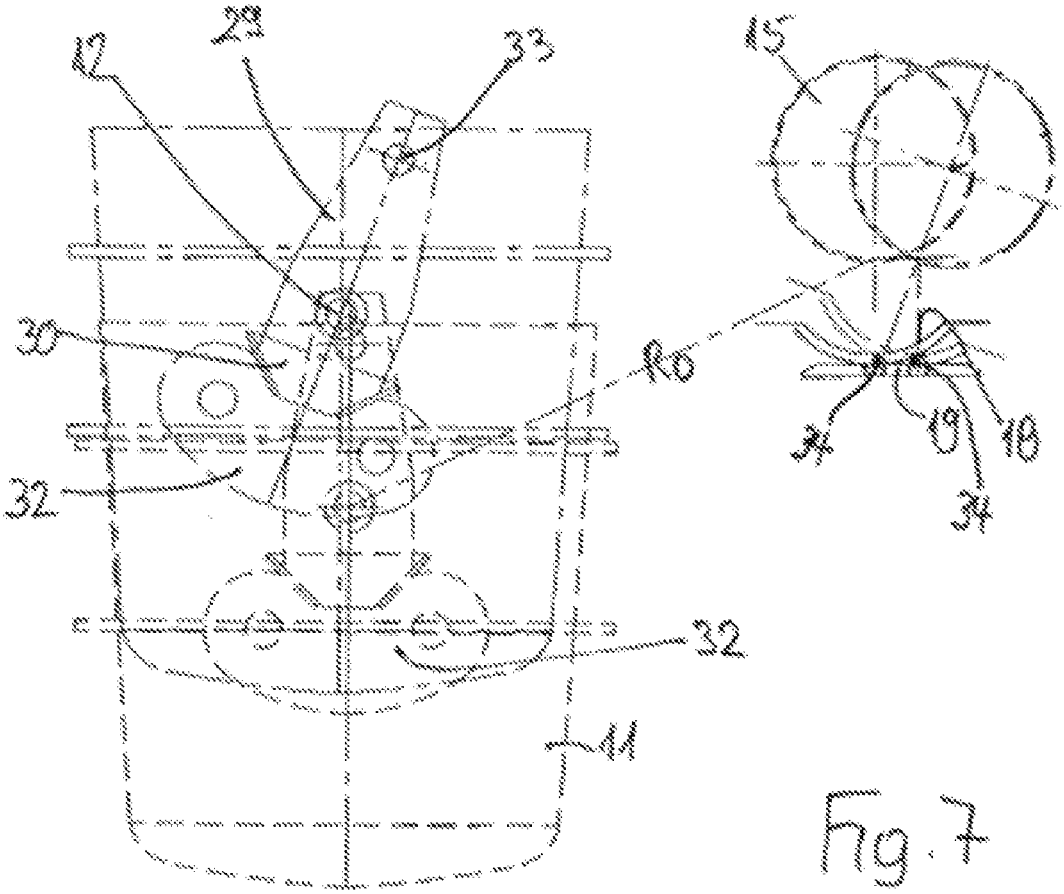
FIG. 7 is a side view of the ladle with support devices having a plate and with a saddle support for the lifting arms.

As can be seen in detail in FIG. 5, the circular arc-shaped runway 18 and the path 19 of rolling contact are each provided with teeth 25 or 26 respectively, so that during a rolling movement the teeth interengage and hence the lifting arms 14 are fixed in the saddle support 17 during their displacement. In this connection, the reference numeral 34 indicates the point of load introduction of the runway 18 into the path 19 of rolling contact; as can be seen in FIG. 7, as the circular arc-shaped runway 18 rolls on the path 19 of rolling contact this point of load introduction 34 shifts axially. The result of this shifting is that during the lifting movement a reduction of the horizontal movement of the ladle occurs.

Figure 6:
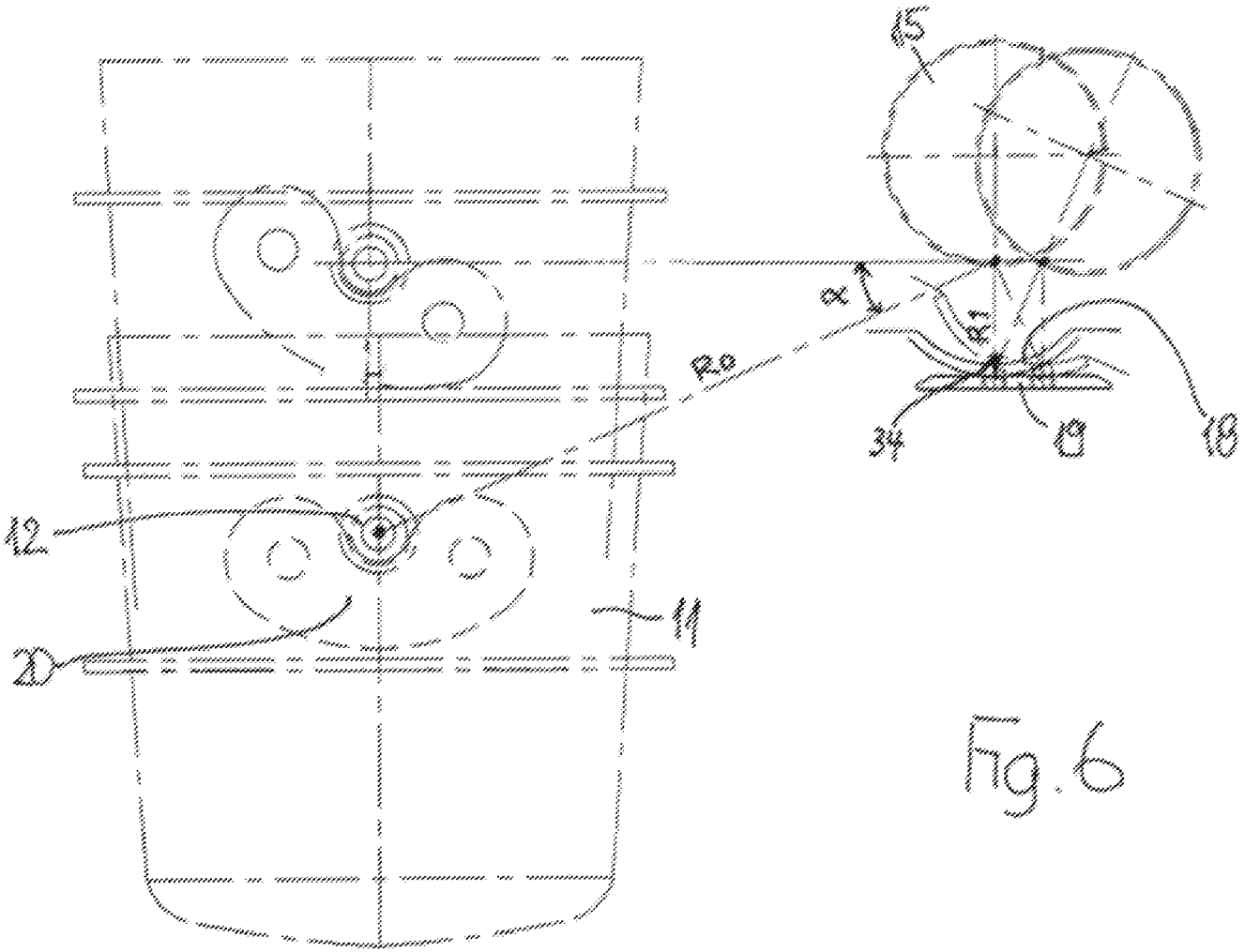
FIG. 6 is a side view of the relative position of the ladle and saddle support for the lifting arms.
Figure 7:
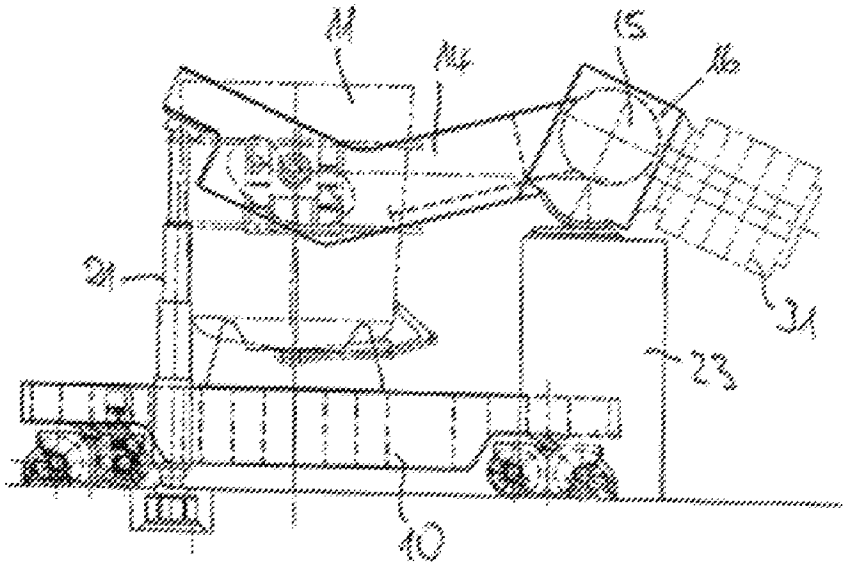

As can be seen in FIG. 6, it is the design in particular of the radius $R_1$ that is critical for the configuration of the circular arc-shaped runway 18, and this radius $R_1$ is approximately determined pursuant to the equation;

$$R_1 = R_0(1-\text{Cos}\ \alpha)/\alpha(\text{arc measure})$$

where $\alpha$ is the pivot angle that is to be carried out during the lifting movement of the ladle 11, and $R_0$ is the pivot radius of the trunnion about the saddle support 17.

The parameters $R_1$ and $R_0$ can be altered as a function of the pivot angle $\alpha$ that the ladle 11 passes through.

As can be seen in FIG. 7, separate lateral plates 29 can also be disposed as supports for receiving the ladle 11, whereby the plates 29 span the furthermore provided trunnions 12 and are pivotable relative to the trunnions. The upper ends of the plates 29 are provided with a connection bolt 33 for the engagement of, for example, crane hooks. If the ladle 11 is raised at the plates 29, due to the rotatable support of the trunnions 12 in the plates 29, the ladle 11 is automatically vertically oriented. This kinematic is used with an embodiment of the invention pursuant to FIG. 7 for the abutment of the lifting arms 14 against the ladle 11 by providing the associated front ends of the lifting arms 14 with receiving means 32 that engage under the respective bottom part 30 of the plates 29 in a form-fitting manner, so that the ladle 11 with the plates 29 is positively supported in the receiving means 32 of the lifting arms 14. If the ladle 11 is now raised by means of the pivoting of the lifting arms 14, the inclined positioning of the plates 29 connected therewith has no effect since the ladle 11 with the trunnions 12 rotatably mounted in the plate 29, automatically orients vertically. It is also additionally illustrated in FIG. 7 how, due to the displacement of the pivot point of the lifting arms 14 in the saddle support 17, a compensation of the horizontal shifting of the vertical axis 27 of the ladle 11 results that with the illustrated embodiment again occurs only to a negligible extent.

Figure 8:
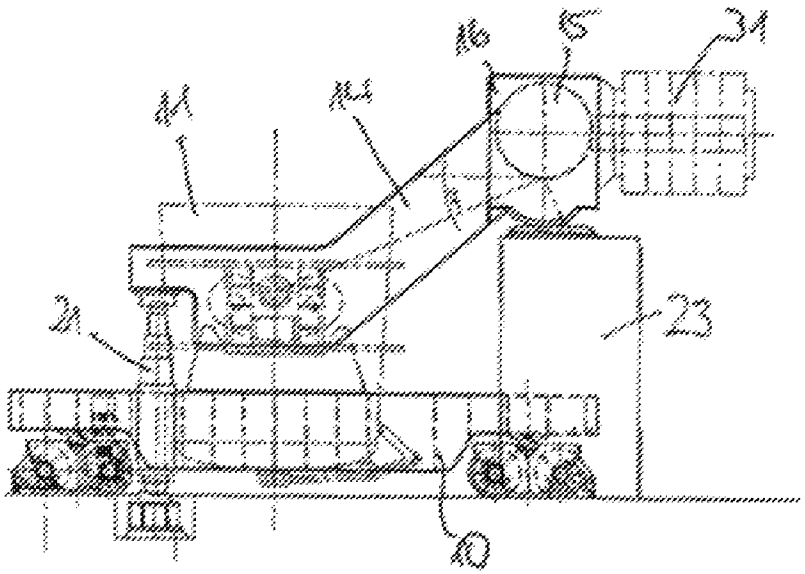

Finally, in the embodiment illustrated in FIGS. 8 and 9, for a better control of the forces that occur at the hoisting mechanism 13, a counterweight 31 is additionally provided on the lifting arms 14, or on the housing box 16 that supports the transverse connection support 15.

The features of the subject matter of this application disclosed in the preceding description, the claims, the abstract and the drawing can be important individually as welt as in any desired combination with one another for realizing the various embodiments of the invention.

The specification incorporates by reference the disclosure of German priority document 10 2006 026 330.824 filed Jun. 2, 2006.

The present invention is, of course, in no way restricted to the specific disclosure of the specification and drawings, but also encompasses any modifications within the scope of the appended claims.

The invention claimed is:

1. A hoisting mechanism for raising a ladle filled with liquid steel from a ladle transfer vehicle to immersion pipes of a vacuum treatment tank of an RH degasser, comprising:

two lifting arms, wherein a first end of at least one of said lifting arms is associated with a hydraulic cylinder and each of said lifting arms comprises a receiving means located between the first end and a second bearing end of the respective lifting arm, the receiving means being adapted to be brought into engagement with a support device formed on said ladle, wherein the second bearing end of each of said lifting arms is supported in a stationary saddle support, wherein each saddle support comprises a runway, which is disposed on said second, bearing ends of said lifting arms and has the shape of a portion of a circular arc, and a path of rolling contact, which is adapted to axially fixedly guide said runway during a pivoting movement of both first ends of the lifting arms actuated by the hydraulic cylinder, such that due to a shifting of a point of load introduction in said saddle support that occurs during the pivoting movement, horizontal movement of said ladle during the pivoting movement is reduced and compensated.

2. A hoisting mechanism according to claim 1, wherein said circular arc-shaped runway and said fixed path of rolling contact are provided with interengaging teeth.

3. A hoisting mechanism according to claim 1, wherein a position of a radius ($R_1$) of said circular arc-shaped runway is adapted to vary as a function of a pivot position of said lifting arms, and wherein as a consequence thereof said runway has a curved configuration.

4. A hoisting mechanism according to claim 1, wherein a transverse connection support is provided that interconnects said two lifting arms and is positioned to extend over said ladle transfer vehicle, and wherein said transverse connection support, which is adapted to be pivoted by the pivoting movement of said lifting arms, is supported and guided in said saddle support.

5. A hoisting mechanism according to claim 4, wherein said transverse connection support is supported in a housing box, and wherein said circular arc-shaped runway is formed on said housing box.

6. A hoisting mechanism according to claim 4, wherein one hydraulic cylinder is associated with a first one of said lifting arms, and wherein said transverse connection support has such a torsional strength that the other one of said lifting arms is carried along during a pivoting movement of said first lifting arm that is acted upon by said hydraulic cylinder.

7. A hoisting mechanism according to claim 4, wherein two hydraulic cylinders are provided and are respectively associated with one of said lifting arms.

8. A hoisting mechanism according to claim 4, wherein said transverse connection support is positioned to extend over said ladle transfer vehicle at such a height that said transfer vehicle, with said ladle supported thereon, is movable below said transverse connection support.

9. A hoisting mechanism according to claim 1, wherein said support devices are in the form of trunnions that project radially from opposite sides of said ladle, and wherein said each of said lifting arms is provided with a cradle-like receiving means for said trunnions that enables a relative movement of said trunnions to said lifting arms.

10. A hoisting mechanism according to claim 1, wherein said support devices are in the form of plates rotatably or pivotably supported on trunnions that project radially from opposite sides of said ladle, and wherein said each of said lifting arms is provided with a receiving means that extends under said plate in a positively or form-fitting manner.

11. A hoisting mechanism according to claim 1, wherein the second bearing ends of said lifting arms are provided with a counterweight that extends beyond said saddle support.

12. A hoisting mechanism for raising a ladle filled with liquid steel from a ladle transfer vehicle to immersion pipes of a vacuum treatment tank of an RH degasser, comprising:

two lifting arms, wherein a first end of at least one of said lifting arms is associated with a hydraulic cylinder and each of said lifting arms comprises a receiving means located between the first end and a second bearing end of the respective lifting arm, the receiving means being, adapted to be brought into engagement with a support device formed on said ladle, wherein the second bearing end of each of said lifting arms is supported in a stationary saddle support, wherein each saddle support comprises a runway, which is disposed on said second, bearing ends of said lifting arms and has the shape of a portion of a circular arc, and a path of rolling contact, which is adapted to axially fixedly guide said runway during a pivoting movement of both first ends of the actuated by the hydraulic cylinder, such that due to a shifting of a point of load introduction in said saddle support that occurs during the pivoting movement, horizontal movement of said ladle during the pivoting movement is reduced and compensated, and wherein said circular arc-shaped runway and said fixed path of rolling contact are provided with interengaging teeth.

13. A hoisting mechanism for raising a ladle filled with liquid steel from a ladle transfer vehicle to immersion pipes of a vacuum treatment tank of an RH degasser, comprising:

two lifting arms, wherein a first end of at least one of said lifting arms is associated with a hydraulic cylinder and each of said lifting arms comprises a receiving means located between the first end and a second bearing end of the respective lifting arm, the receiving means being adapted to be brought into engagement with a support device formed on said ladle, wherein the second bearing end of each of said lifting arms is supported in a stationary saddle support, wherein each saddle support comprises a runway, which is disposed on said second, bearing ends of said lifting arms and has the shape of a portion of a circular arc, and a path of rolling contact, which is adapted to axially fixedly guide said runway during a pivoting movement of both first ends of the actuated by the hydraulic cylinder, such that due to a shifting of a point of load introduction in said saddle support that occurs during the pivoting movement, horizontal movement of said ladle during the pivoting movement is reduced and compensated, and wherein said support devices are in the form of plates rotatably or pivotably supported on trunnions that project radially from opposite sides of said ladle, and wherein said each of said lifting arms is provided with a receiving means that extends under said plate in a positively or form-fitting manner.

14. A hoisting mechanism for raising a ladle filled with liquid steel from a ladle transfer vehicle to immersion pipes of a vacuum treatment tank of an RH degasser, comprising:

two lifting arms, wherein a first end of at least one of said lifting arms is associated with a hydraulic cylinder and each of said lifting arms comprises a receiving means located between the first end and a second bearing end of the respective lifting arm, the receiving means being adapted to be brought into engagement with a support device formed on said ladle, wherein the second bearing end of each of said lifting arms is supported in a stationary saddle support, wherein each saddle support comprises a runway, which is disposed on said second, bearing ends of said lifting arms and has the shape of a portion of a circular arc, and a path of rolling contact, which is adapted to axially fixedly guide said runway during a pivoting movement of both first ends of the actuated by the hydraulic cylinder, such that due to a shifting of a point of load introduction in said saddle support that occurs during the pivoting movement, horizontal movement of said ladle during the pivoting movement is reduced and compensated, and wherein said lifting arms are lengthened beyond said saddle support to form an end that extends beyond said saddle support, and wherein said end that extends beyond said saddle support is provided with a counterweight.

* * * * *